US005794930A

United States Patent [19]

Glanzmann et al.

[11] Patent Number: 5,794,930

[45] Date of Patent: Aug. 18, 1998

[54] APPARATUS FOR FEEDING THE GATHERING SEGMENT OF A GATHER-STITCHER

[75] Inventors: Alfred Glanzmann, Reiden; Heinz Boss, Strengelbach, both of Switzerland

[73] Assignee: Grapha-Holding AG, Hergiswil, Switzerland

[21] Appl. No.: 570,555

[22] Filed: Dec. 11, 1995

[30] Foreign Application Priority Data

Dec. 14, 1994 [CH] Switzerland ..... 03 780/94

[51] Int. Cl.[6] ..... B65H 5/02

[52] U.S. Cl. ..... 271/277; 271/314

[58] Field of Search ..... 271/275–277, 271/314, 264; 270/52.14, 52.21, 52.22, 52.23, 60, 58.01; 198/836.2, 481.1, 644

[56] References Cited

U.S. PATENT DOCUMENTS 2,830,813 4/1958 Hepp .

4,162,066 7/1979 McCain et al. ..... 270/52.14 X

FOREIGN PATENT DOCUMENTS 586611 4/1977 Switzerland .

617905 6/1980 Switzerland .

652103 10/1985 Switzerland .

*Primary Examiner*—David H. Bollinger

*Attorney, Agent, or Firm*—Spencer & Frank

[57] ABSTRACT

To load a gathering segment of a gather-stitcher, a printed sheet feeder includes a conveyor drum that draws printed sheets from the bottom of a stack. A stop apparatus halts the printed sheets at the end of their circulating path at the conveyor drum and is disposed downstream of a guide device which, with the conveyor drum, forms a guide gap. An opening apparatus follows the stop apparatus and is disposed upstream of the printed sheets. The guide gap is adjustable by the conveyed printed sheets.

12 Claims, 1 Drawing Sheet

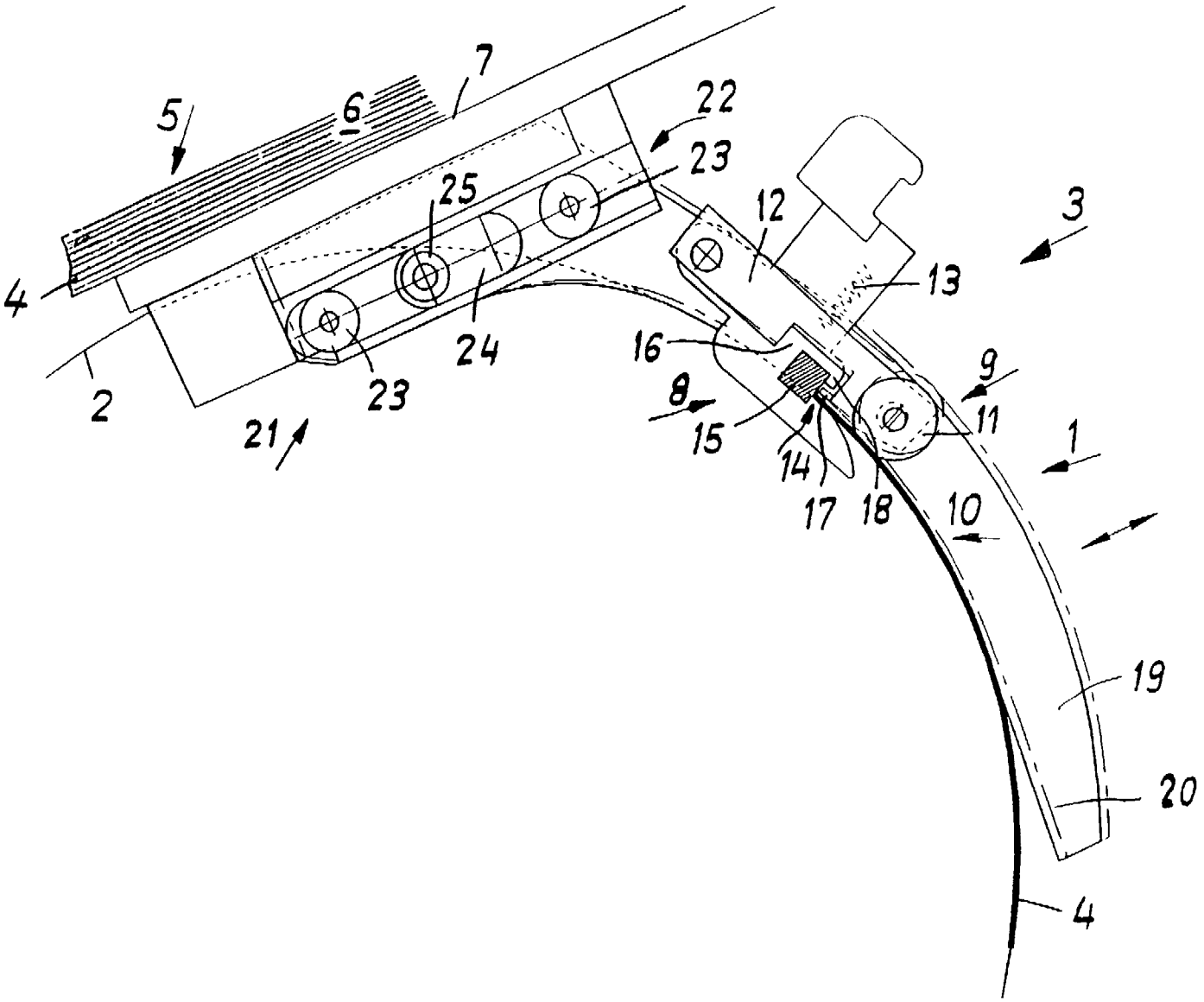
1
2
3
4
5
6
7
8
9
10
11
12
13
14
15
16
17
18
19
20
21
22
23
24
25

APPARATUS FOR FEEDING THE GATHERING SEGMENT OF A GATHER-STITCHER

CROSS-REFERENCE TO RELATED APPLICATION

This application claims the priority of Swiss Patent Application Serial No. 03 780/94-3, filed Dec. 14, 1994, in Switzerland, the subject matter of which is incorporated herein by reference.

BACKGROUND OF THE INVENTION

The invention relates to an apparatus for loading a gathering segment of a gather-stitcher with printed sheets, the apparatus including: a rotating conveyor drum defining a circulating path for the printed sheets; a suction apparatus drawing individual printed sheets fold-forward from a stack of a sheet hopper adjacent the drum and partially lifting the individual printed sheets from a lower side of the stack; a gripping apparatus associated with the drum for gripping the lifted printed sheets and conveying the printed sheets on the circulating path; a stop apparatus disposed on the circulating path of the printed sheets and including a stop for stopping the printed sheets at the fold; a guide arrangement including a guide device disposed upstream of the stop apparatus and together with the conveyor drum forming a guide gap for receiving the printed sheets; and an opening apparatus facing away from the stop apparatus for moving the printed sheets away from the stop apparatus in an opposite direction, the opening apparatus having a work region terminating in the gathering segment of the gather-stitcher.

Apparatuses of the type mentioned above, also known as feeders, are the Achilles heel of the process of feeding the gathering segment of a gather-stitcher with printed sheets of varying paper quality and thickness.

In particular, the guidance of printed sheets before the stop for the fold of a printed sheet pulled from a stack often leads to feed errors which result in the ejection of a defective printed product at the end of the gathering or stapling process.

This deficiency can be attributed in many cases to an imprecise setting of the printed sheet guidance or the guide arrangement before the stop, where the printed sheet is subjected to an impact and jolting effect. The printed sheet has a tendency to lift, at least partially, from the conveyor drum and assume such a position in the guide gap that it cannot always be gripped in the correct position by the opening apparatus that subsequently acts upon the opposite edges of the open pages. A more precise adaptation of the guide gap to the different printed sheets could improve reliability in production.

SUMMARY OF THE INVENTION

It is an object of the invention to provide an apparatus of the type mentioned at the outset, with which reliability can be improved with respect to processing quality, and production time can be decreased.

The above and other objects are accomplished in accordance with the invention, by providing, in the context of the apparatus first described above, a means for automatically adjusting the width of the guide gap in front of the stop in dependence of a thickness of the conveyed printed sheets.

Due to the position of the guide arrangement at the conveyor drum, above the horizontal plane extending through the axis of rotation of the drum, a situation can be utilized which encourages the sliding effect in the guide gap, particularly because the gravitational force, which has a static effect at the guide arrangement, can be reduced significantly.

The resulting favorable frictional conditions simultaneously effect gentle handling of the printed sheets.

The guide arrangement is advantageously adjusted counter to a force generated by gravitation and/or a spring. This force should also preferably be selected to be adjustable.

The guide arrangement is formed of a rotatable guide roller, which is disposed upstream of the stop apparatus and can be moved approximately perpendicular to the path of the printed sheets or the conveyor drum in the guide gap, and a guiding member which adjoins the guide roller and can be operated independently of the latter. The guide roller is advisably seated on a support which, with the lower edge, forms the entrance opening to the stop, so that the printed sheet impacting against the stop does not deviate from its position. In other words, the printed sheets assume a constant position for gripping with respect to the downstream opening apparatus.

A lever having the guide roller seated at its free end is particularly suited as a support. In this instance, instead of a pivoting axis being used for the lever, the support could be moved in a guide in order to serve the same purpose. For the sake of simplicity, the support, or lever, is secured to the stop apparatus.

For adjustment of the guide gap in front of the stop due to deviating behavior of the different printed sheets upon impact at the stop, it is advantageous to configure the guide roller to be adjustable in a space between itself and the stop which is located opposite the lower edge of the support facing the conveyor drum.

A lug is associated with the support, or lever, in order to limit the maximum guide gap width at the stop.

The guiding member is advantageously connected to a guide apparatus and controlled so as to be lifted from the conveyor drum in approximately radial fashion with respect to the axis of rotation of the drum, so that virtually uniform frictional conditions are present at the affected printed sheet surfaces in the guide gap.

For this purpose, the guide apparatus is preferably configured with a roller guide that has a relatively favorable frictional coefficient.

For gentle handling of printed sheets, the direction of movement of the guide arrangement or the guiding member, or the guide apparatus connected to the guiding member, forms an angle of less than 45° with a horizontal plane extending through the axis of rotation of the conveyor drum.

BRIEF DESCRIPTION OF THE DRAWING

These and other features and advantages of the invention will be further understood from the following detailed description of the preferred embodiments with reference to the accompanying drawing in which:

The sole drawing FIGURE shows a fragmentary view of a guide arrangement according to the invention for printed sheets in a feeder.

DETAILED DESCRIPTION OF THE PREFERRED EMBODIMENT

Referring to the FIGURE, there is shown a guide arrangement 1 at the conveyor drum 2 of a printed sheet feeder 3 for a gather-stitcher (not shown), as disclosed, for example, in Swiss Patent Nos. 586,611; 617,905; and 652,103. Feeder 3 serves to load a gathering segment of the gather-stitcher, and includes rotating conveyor drum 2, which draws the printed sheets fold-forward from a stack 5 of an adjacent sheet hopper 6, of which the table 7 is shown in the FIGURE.

Associated with this conveyor drum 2 are a suction apparatus (not shown) which partially lifts the individual printed sheets 4 from a lower side of stack 5 and a gripping apparatus (not shown) that grips the lifted printed sheets. The feeder further comprises a stop apparatus 8 including a stop 15, which is disposed on the circulating path of printed sheets 4 and stops the printed sheets at their fold. Stop apparatus 8 cooperates with an upstream guide device 9 which, together with conveyor drum 2, forms a guide gap 10. Guide device 9 also acts on printed sheets 4 when they are gripped by an opening apparatus (not shown) and transported further on the collection segment in the opposite direction.

Printed sheets 4 conveyed to stop apparatus 8 lift guide device 9 from conveyor drum 2, a process which takes place counter to a force created by gravity at guide device 9 and/or counter to a spring force. A guide roller 11, which is seated to rotate freely on a lever 12 and is set into rotation by a printed sheet 4 in guide gap 10, is located upstream of the stationary stop apparatus 8. In an inoperative position, guide roller 11 is located at conveyor drum 2 due to a compression spring 13 that acts on lever 12.

Stop apparatus 8 includes an adjustable entrance opening 14 that leads to stop 15 and is formed on one side by a lower guide surface which is curved from below to align with the conveyor drum 2, and on the other side by a lower edge of lever 12. The stop 15 itself is made of rubber or a rubber alloy and dampens the impact of printed sheets 4. For limiting entrance opening 14, a recess 16 is provided with a lug 17 that is associated with an end stop 18 on stop apparatus 8.

Guide device 9 further comprises a guiding member 19, which, with the exception of an end segment 20 facing away from stop 15, extends approximately parallel to the circumference of the conveyor drum 2 over the length of guide gap 10.

Between stop 15 and guide roller 11, the lower edge of lever 12 forms a segment of guide gap 10. To adjust the width of the passage of this segment, guide roller 11 is seated to be adjustable, for example by an eccentrically rotatable shaft, on lever 12. Guiding member 19 is in turn connected to a guide apparatus 21 and guided to be lifted approximately radially from conveyor drum 2 by guide apparatus 21. Printed sheets 4 that create guide gap 10 have a thickness of up to about 2 mm.

It is necessary for end segment 20 of guiding member 19 opposite stop 15 at guide gap 10 to be formed by an approximately tangential course with respect to conveyor drum 2, with a widening of guide gap 10.

Guide apparatus 21 may be comprised of a roller guide including a roller track 22 which is secured to an underside of table 7 of sheet hopper 6 and in which running rollers 23 connected to guiding member 19 are disposed. A slot 24 extending parallel to roller track 22 forms, with a stop pin 25 connected to guiding member 19, the maximum lifting segment of guiding member 19 from conveyor drum 2. A lifting of guiding member 19 from conveyor drum 2 by more than the thickness of the printed sheets 4 allows removal of printed sheets 4 in the event of an operational disturbance.

It is also possible to connect running rollers 23 to stationary table 7, and roller guide 22 to guiding member 19. The direction of movement of the guide arrangement 1, or of the guide apparatus 21 connected to the guide device 9 or guiding member 19, forms an angle of approximately 30°, and preferably not greater than a maximum of 45°, with a horizontal plane extending through the axis of rotation of conveyor drum 2.

It will be understood that the above description of the present invention is susceptible to various modifications, changes and adaptations, and the same are intended to be comprehended within the meaning and range of equivalents of the appended claims.

What is claimed is:

1. In an apparatus for loading a gathering segment of a gather-stitcher with printed sheets, the apparatus including: a rotating conveyor drum defining a circulating path for the printed sheets; a stop apparatus disposed on the circulating path of the printed sheets and including a stop for stopping the printed sheets; a guide arrangement including a guide device disposed upstream of the stop apparatus and together with the conveyor drum forming a guide gap for receiving the printed sheets; the gathering segment of the gather-stitcher constituting a work region of an opening apparatus facing away from the stop apparatus for moving the printed sheets away from the stop apparatus in an opposite direction, the improvement wherein:

the guide device is displaceable for automatically adjusting the guide gap in front of the stop in dependence of a thickness of the respectively conveyed printed sheets.

2. An apparatus as defined in claim 1, wherein the guide device is arranged to be adjustable counter to a force caused by gravity.

3. An apparatus as defined in claim 2, wherein the guide device includes a support having a lower edge forming an entrance opening to the stop and a rotatable guide roller seated on the support upstream of the stop apparatus and displaceably mounted on the support for movement approximately perpendicular to a path of the printed sheets in the guide gap; and a guiding member adjoining the guide roller and being operable independently of the guide roller.

4. An apparatus as defined in claim 3, wherein the support comprises a lever having a free end at which the guide roller is seated.

5. An apparatus as defined in claim 3, wherein the support is secured to the stop apparatus.

6. An apparatus as defined in claim 3, wherein the stop is located opposite the lower edge of the support facing the conveyor drum and the guide roller is adjustable in a space between the guide roller and the stop.

7. An apparatus as defined in claim 3, further comprising means associated with the support defining an end stop which forms a maximum guide gap width at the stop.

8. An apparatus as defined in claim 3, further comprising a guide apparatus to which the guiding member is connected for lifting the guiding member from the conveyor drum approximately radially with respect to an axis of rotation of the conveyor drum.

9. An apparatus as defined in claim 8, wherein the guiding member has an end segment facing away from the stop and extending approximately tangentially to the conveyor drum.

10. An apparatus as defined in claim 8, wherein the guide apparatus comprises a roller guide.

11. An apparatus as defined in claim 8, wherein a direction of movement of the guiding member and of the guide apparatus connected thereto forms an angle of less than 45° with a horizontal plane that passes through the axis of rotation of the conveyor drum.

12. An apparatus as defined in claim 1, and further comprising a compression spring presenting a spring force biasing the guide device in a direction toward the conveyor drum so that the guide device is adjustable counter the spring force.

* * * * *